US008397703B2

(12) United States Patent
Jaffrezic et al.

(10) Patent No.: US 8,397,703 B2
(45) Date of Patent: Mar. 19, 2013

(54) HIGH VOLTAGE RESONATOR-AMPLIFIER WITH AN OPTIMIZED STRUCTURE FOR RADIOFREQUENCY IGNITION SYSTEM

(75) Inventors: Xavier Jaffrezic, Velizy (FR); Marc Pariente, Paris (FR); Andre Agneray, Boulogne Billancourt (FR)

(73) Assignee: Renault S.A.S., Boulogne Billancourt (FR)

( * ) Notice: Subject to any disclaimer, the term of this patent is extended or adjusted under 35 U.S.C. 154(b) by 0 days.

(21) Appl. No.: 13/263,633

(22) PCT Filed: Feb. 15, 2010

(86) PCT No.: PCT/FR2010/050246

§ 371 (c)(1),
(2), (4) Date: Dec. 8, 2011

(87) PCT Pub. No.: WO2010/119197

PCT Pub. Date: Oct. 21, 2010

(65) Prior Publication Data

US 2012/0086325 A1 Apr. 12, 2012

(30) Foreign Application Priority Data

Apr. 14, 2009 (FR) ..... 09 52443

(51) Int. Cl.
*H01F 38/12* (2006.01)

(52) U.S. Cl. ..... 123/634; 123/143 B; 123/635

(58) Field of Classification Search ..... 123/634, 123/635

See application file for complete search history.

(56) References Cited

U.S. PATENT DOCUMENTS 6,608,543 B2 * 8/2003 Rapoport et al. ..... 336/90
2005/0241627 A1 * 11/2005 Ward ..... 123/634

FOREIGN PATENT DOCUMENTS

FR 2 859 869 3/2005

OTHER PUBLICATIONS

International Search Report Issued May 7, 2010 in PCT/FR10/050246 Filed Feb. 15, 2010.

* cited by examiner

*Primary Examiner* — Erick Solis
(74) *Attorney, Agent, or Firm* — Oblon, Spivak, McClelland, Maier & Neustadt, L.L.P.

(57) ABSTRACT

A high voltage resonator-amplifier for a radiofrequency ignition system that can be used in an internal combustion engine, the resonator-amplifier including at least two electrodes, a coil arranged in alignment with the electrodes along a longitudinal axis, and a linking mechanism retaining the coil and the electrodes in a relatively fixed position. The coil is wound around a closed bend which in turn wraps around the longitudinal axis.

13 Claims, 3 Drawing Sheets

HIGH VOLTAGE RESONATOR-AMPLIFIER WITH AN OPTIMIZED STRUCTURE FOR RADIOFREQUENCY IGNITION SYSTEM

BACKGROUND OF THE INVENTION

The invention relates, generally, to plasma generation techniques.

More precisely, the invention relates to a high-voltage resonator-amplifier for radiofrequency ignition system usable in an internal combustion engine, this resonator-amplifier comprising at least two electrodes, a coil arranged in forward alignment relative to the electrodes in relation to a longitudinal axis, and linking means holding the coil and the electrodes in a fixed relative position.

A resonator-amplifier of this type, generally dubbed "spark plug coil", is in particular known to the person skilled in the art through patent FR 2 859 869.

In so far as spark plug coils are mounted in the cylinder head of the engine, their structure is heavily conditioned by the structure of this cylinder head.

The shape of the cylinder head as well as the free spaces made available therein are therefore crucial parameters to be taken into account in the design of these spark plug coils.

Now, not only are today's cylinder heads divided into two types, depending on whether they do or do not comprise an access well for the ignition spark plug, but also the diameter of the access wells is tending to decrease for cylinder heads of the second type.

Hence, the adaptation to these new conditions of use of spark plug coils of tubular shape as described and illustrated in the above-mentioned patent is becoming increasingly tricky.

SUMMARY OF THE INVENTION

In this context, the aim of the present invention is to propose a high-voltage resonator-amplifier or "spark plug coil" whose structure addresses this requirement for development.

To this end, the resonator-amplifier of the invention, moreover in accordance with the generic definition thereof given by the above preamble, is essentially characterized in that the coil is wound around a closed curve which itself surrounds the longitudinal axis.

BRIEF DESCRIPTION OF THE DRAWINGS

Other characteristics and advantages of the invention will emerge clearly from the description thereof given hereinafter, by way of wholly nonlimiting indication, with reference to the appended drawings, in which.

DETAILED DESCRIPTION OF THE INVENTION

As declared previously, the invention relates to a high-voltage resonator-amplifier intended to be fitted to a radiofrequency ignition system for an internal combustion engine.

Figure 1:
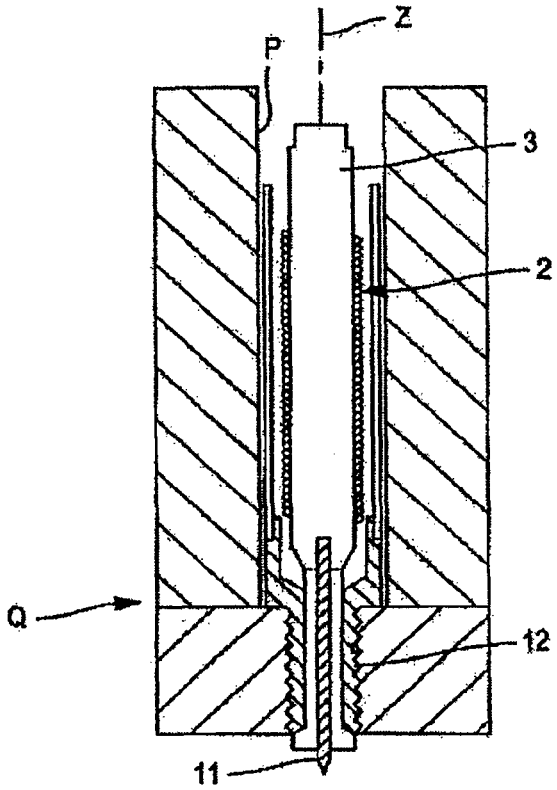
FIG. 1 Background Art
FIG. 1 is a sectional schematic view of a known example of a resonator-amplifier with tubular coil.

A known resonator-amplifier is illustrated in FIG. 1 and comprises two electrodes 11 and 12, a coil 2 arranged in forward alignment relative to the electrodes in relation to a longitudinal axis Z, and linking means 3 whose function is at least to hold the coil 2 and the electrodes 11 and 12 in a fixed relative position.

The ground electrode 12, which surrounds the central electrode 11, bears a threading which makes it possible to screw it into the cylinder head Q of the engine.

As shown by FIG. 1, known resonator-amplifiers exhibit a structure adapted to engines whose cylinder head Q exhibits an access well P intended to receive them.

Figure 2:
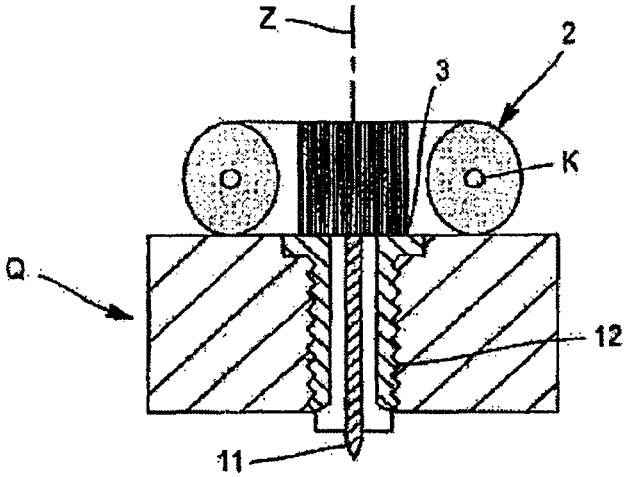
FIG. 2 is a sectional schematic view of a resonator-amplifier in accordance with a first possible embodiment of the invention.
Figure 3:
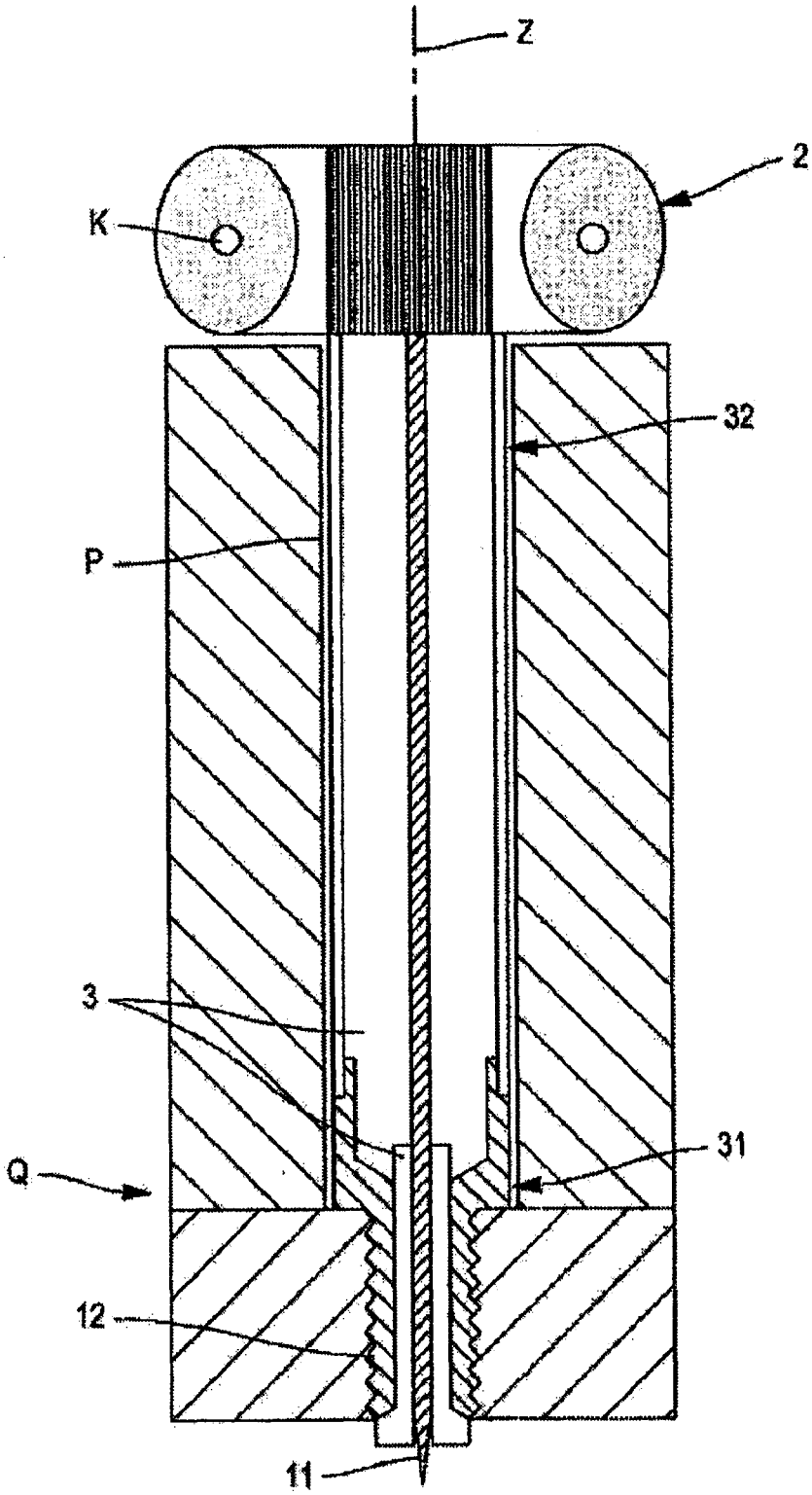
FIG. 3 is a sectional schematic view of a resonator-amplifier in accordance with a second possible embodiment of the invention.

In the resonator-amplifier of the invention, which is adaptable to cylinder heads of all geometries, the coil 2 is wound around a closed curve K which itself surrounds the longitudinal axis Z (FIGS. 2 and 3).

In the case where the cylinder head Q does not exhibit any access well, the linking means can thus be restricted to a minimal structure, as shown by FIG. 2.

In the case where the cylinder head Q exhibits an access well P (FIG. 3), the linking means comprise a body 3 which is elongate in relation to the longitudinal axis Z.

The lower end 31 of the body 3 then carries the functional ends of the electrodes 11 and 12, while the coil 2 is carried by the upper end 32 of this body 3.

As shown by FIGS. 4A to 6B, the coil 2 comprises two conducting wire connection leads, 201 and 202, intended to allow the connection of this coil 2 to an electrical energy source (not represented), and a set of windings such as 21A to 24B, mounted in series between the connection leads 201 and 202.

Figure 4A:
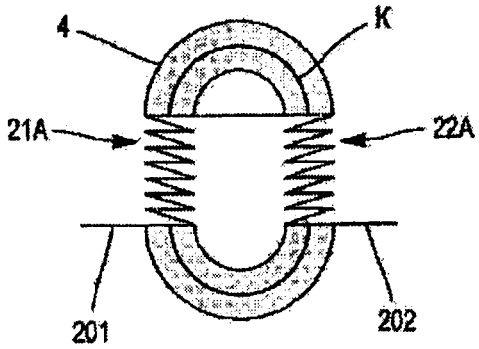
FIG. 4A is a schematic view from above of a coil of a first type, usable for the implementation of the invention.
Figure 4B:
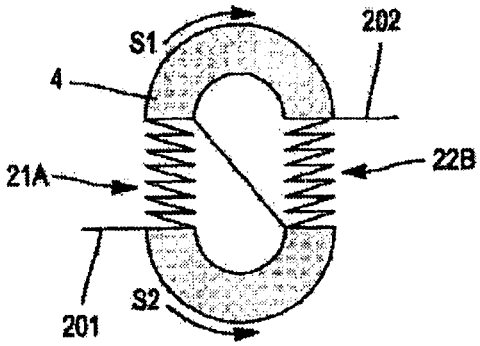
FIG. 4B is a schematic view from above of a variant of the coil illustrated in FIG. 4A, optimized for the implementation of the invention.
Figure 5A:
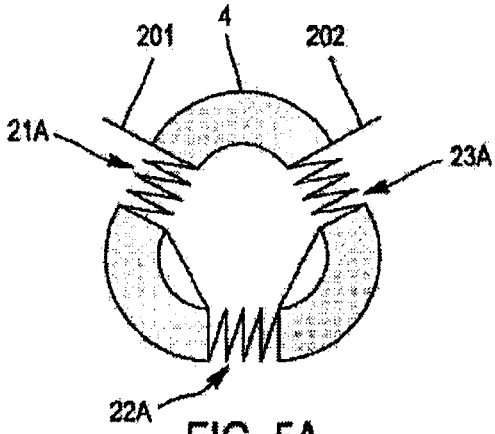
FIG. 5A is a schematic view from above of a coil of a second type, usable for the implementation of the invention.
Figure 5B:
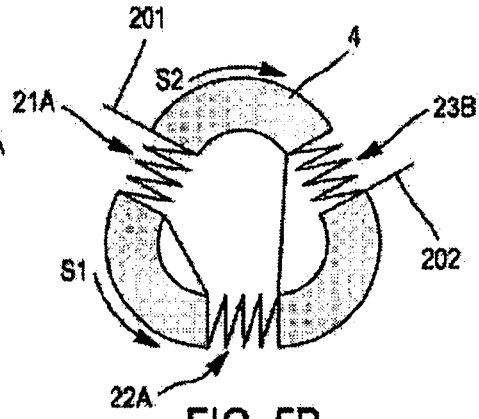
FIG. 5B is a schematic view from above of a variant of the coil illustrated in FIG. 5A, optimized for the implementation of the invention.
Figure 6A:
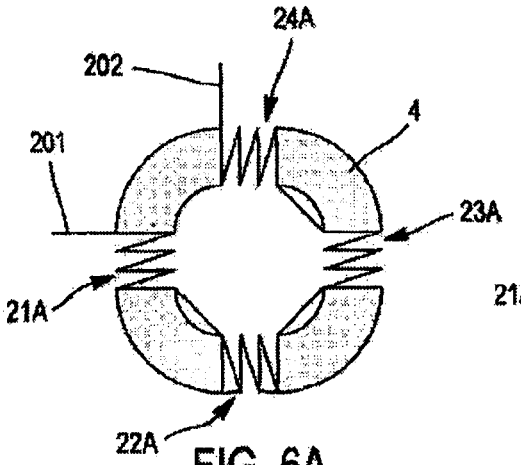
FIG. 6A is a schematic view from above of a coil of a third type, usable for the implementation of the invention.
Figure 6B:
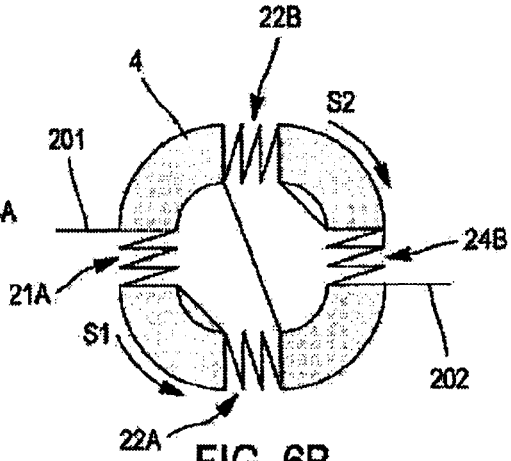
FIG. 6B is a schematic view from above of a variant of the coil illustrated in FIG. 6A, optimized for the implementation of the invention.

In the most advantageous embodiments, which are illustrated in FIGS. 4B, 5B and 6B and which are presented hereinafter, the set of windings of the coil 2 is formed of a first subset of windings such as 21A and 22A, comprising at most two thirds of the windings of the coil, and of a second subset of windings such as 22B, 23B and 24B, comprising at least one third of the windings of this coil.

Preferably, if the total number of windings of the coil 2 is even, the two subsets comprise the same number of windings, and if the total number of windings of the coil 2 is odd, the two subsets comprise the same number of windings to within a unit.

Each winding is coiled on a part of the closed curve K, the windings of the first subset, namely 21A and 22A, and the windings of the second subset, namely 22B, 23B, and 24B, being coiled in opposite directions, at one and the same time along the curve K and around this curve.

Thus, in the case where the windings 21A and 22A are coiled in the direction of traversal S1 of the curve K, the windings 22B, 23B, and 24B are coiled in the direction of traversal S2 of this curve K, and vice versa.

Likewise, if the windings 21A and 22A are coiled around the curve K in a levogyratory direction of winding, the windings 22B, 23B, and 24B are coiled around this curve K in a dextrogyratory direction of winding, and vice versa.

This layout, which allows the various windings to contribute in the same manner to the construction of the magnetic field of the coil 2 without, however, having to be coiled in the same direction, allows the leads 201 and 202 to be spaced apart and the potential difference between the leads 201 and 202 to be divided by a factor of two or around two.

The windings 21A and 22A of the first subset can for example be contiguous, that is to say arranged on the closed curve K in succession to one another, the windings 22B, 23B, and 24B of the second subset therefore being themselves arranged on the curve K in succession to one another.

In practice, the windings 21A and 22A of the first subset are preferably arranged on the closed curve K in succession to one another in the same direction of traversal as these windings themselves, and therefore advantageously follow one another in the direction S1 if these windings 21A and 22A are individually coiled in the direction S1, or in the direction S2 if these windings 21A and 22A are individually coiled in the direction S2.

Likewise, the windings 22B, 23B, and 24B of the second subset are preferably arranged on the closed curve K in succession to one another in the same direction of traversal as these windings themselves, and therefore advantageously follow one another in the direction S1 if these windings 22B, 23B, and 24B are individually coiled in the direction S1, or in the direction S2 if these windings 22B, 23B, and 24B are individually coiled in the direction S2.

Finally, it may be judicious, in particular in the case where the total number of windings of the coil 2 is small, to equip this coil with a core 4 of ferromagnetic material which closes up on itself along the closed curve K, and on which each of these windings is coiled.

The invention claimed is:

1. A high-voltage resonator-amplifier for a radiofrequency ignition system usable in an internal combustion engine, the resonator-amplifier comprising:

at least two electrodes;

a coil arranged in forward alignment relative to the electrodes in relation to a longitudinal axis; and linking means holding the coil and the electrodes in a fixed relative position, wherein the coil is wound around a closed curve which itself surrounds the longitudinal axis, and the coil is configured to be positioned external to a cylinder head access well of the internal combustion engine.

2. The resonator-amplifier as claimed in claim 1, wherein the linking means comprises a body which is elongate in relation to the longitudinal axis and of which a first end carries functional parts of the electrodes, and wherein the coil is carried by a second end of the body, opposite the first end.

3. The resonator-amplifier as claimed in claim 1, wherein the coil comprises first and second conducting wire connection leads, configured to connect the coil to an electrical energy source, and a set of at least two windings mounted in series between the first and second connection leads, wherein each winding of a first subset of windings comprising at most two thirds of the windings of the set is coiled on a part of the closed curve in a first direction of traversal chosen between clockwise and anti-clockwise, by being wound in a first direction of winding chosen between the levogyratory direction and the dextrogyratory direction, and wherein each winding of a second subset of windings comprising at least one third of the windings of the set is coiled on a part of the closed curve in a direction of traversal counter to the first direction of traversal, by being wound in a direction of winding counter to the first direction of winding.

4. The resonator-amplifier as claimed in claim 3, wherein the windings of each subset are arranged on the closed curve in succession to one another.

5. The resonator-amplifier as claimed in claim 3, wherein the windings of the first subset are arranged on the closed curve in succession to one another in the first direction of traversal.

6. The resonator-amplifier as claimed in claim 3, wherein the windings of the second subset are arranged on the closed curve in succession to one another in the direction of traversal counter to the first direction of traversal.

7. The resonator-amplifier as claimed in claim 3, wherein the set of windings comprises an even number of windings, and wherein each of the first and second subsets comprises half the windings of the set.

8. The resonator-amplifier as claimed in claim 3, wherein the set of windings comprises an odd number of windings, and wherein the first and second subsets comprise, to within a unit, a same number of windings.

9. The resonator-amplifier as claimed in claim 1, wherein the coil comprises a core of ferromagnetic material closing up on itself along the closed curve, and on which each winding is coiled.

10. The resonator-amplifier as claimed in claim 1, wherein the coil comprises a first set of windings including two distinct windings that are spaced apart and a second set of windings including two distinct windings that are spaced apart.

11. The resonator-amplifier as claimed in claim 1, wherein the coil comprises a set of windings including two distinct windings that are spaced apart from each other and an extra winding that is spaced apart from the set of windings.

12. The resonator-amplifier as claimed in claim 10, wherein the first set of windings are electrically connected to the second set of windings.

13. The resonator-amplifier as claimed in claim 11, wherein the set of windings are electrically connected to the extra winding.

* * * * *